US007685778B2

(12) United States Patent
Edell

(10) Patent No.: US 7,685,778 B2
(45) Date of Patent: Mar. 30, 2010

(54) RODENT GUARD

(76) Inventor: James J. Edell, 7981 SE. Double Tree Dr., Hobe Sound, FL (US) 33455

( * ) Notice: Subject to any disclaimer, the term of this patent is extended or adjusted under 35 U.S.C. 154(b) by 0 days.

(21) Appl. No.: 12/124,485

(22) Filed: May 21, 2008

(65) Prior Publication Data

US 2008/0295418 A1 Dec. 4, 2008

Related U.S. Application Data

(60) Provisional application No. 60/933,082, filed on Jun. 4, 2007.

(51) Int. Cl.
*E04D 13/08* (2006.01)
*E04D 13/00* (2006.01)
*A01K 3/00* (2006.01)

(52) U.S. Cl. ..... 52/16; 52/12; 52/101; 43/121; 43/124

(58) Field of Classification Search ..... 52/12, 52/16, 101; 137/358, 360, 527.6, 527.8, 137/873; 114/221 R; 43/121, 124
See application file for complete search history.

(56) References Cited

U.S. PATENT DOCUMENTS

| | | | | | |
|---|---|---|---|---|---|
| 830,112 | A | | 9/1906 | Tenold | |
| 1,063,637 | A | | 6/1913 | Barker | |
| 2,093,515 | A | * | 9/1937 | Filkins | 210/116 |
| 2,927,596 | A | * | 3/1960 | Carlson | 137/146 |
| 2,947,321 | A | | 8/1960 | Kovalcik | |
| 2,975,805 | A | * | 3/1961 | Horn | 239/508 |
| 3,289,840 | A | | 12/1966 | Kahn | |
| 4,150,505 | A | | 4/1979 | Voelker | |
| 4,356,087 | A | | 10/1982 | Miles | |
| 4,501,665 | A | | 2/1985 | Wilhelmson | |
| D288,840 | S | * | 3/1987 | Williams | D23/261 |
| 4,702,828 | A | | 10/1987 | Mehmert et al. | |
| 4,757,638 | A | * | 7/1988 | Lafforthun | 43/66 |
| D301,164 | S | * | 5/1989 | Weaver | D23/267 |
| 5,044,396 | A | | 9/1991 | Daudet et al. | |
| 5,058,312 | A | * | 10/1991 | Jackson | 43/124 |
| 5,092,229 | A | | 3/1992 | Chen | |
| 5,102,537 | A | | 4/1992 | Jones | |
| 5,361,533 | A | * | 11/1994 | Pepper | 43/124 |

(Continued)

FOREIGN PATENT DOCUMENTS

| | | |
|---|---|---|
| EP | 1627975 | 2/2006 |

(Continued)

*Primary Examiner*—Richard E Chilcot, Jr.
*Assistant Examiner*—Mark R Wendell
(74) *Attorney, Agent, or Firm*—Michael K. Dixon; Akerman Senterfitt

(57) ABSTRACT

A rodent guard configured to be attached to an end of a gutter for preventing rodents from entering the gutter, climbing the gutter to the roof and entering a house is disclosed. The rodent guard may include a gutter receiving opening at one end and a cover receiving opening at a second end generally opposite to the first end. A perforated cover formed from a rigid material may be removably attached to the rodent guard body at the second end that enables the cover to be removed from the base during use such that debris within the gutter can be easily removed from the gutter. The perforated cover may be sized to allow water to pass through the cover, but prevent rodents from entering the gutter through the cover.

18 Claims, 4 Drawing Sheets

U.S. PATENT DOCUMENTS

| | | | | |
|---|---|---|---|---|
| 5,427,417 | A * | 6/1995 | Lechuga | 285/46 |
| 5,526,612 | A * | 6/1996 | Wade | 52/12 |
| 5,658,092 | A * | 8/1997 | Sweers | 405/118 |
| 5,867,944 | A * | 2/1999 | Attaway | 52/16 |
| 5,918,427 | A * | 7/1999 | VanderWerf | 52/100 |
| 5,985,158 | A * | 11/1999 | Tiderington | 210/767 |
| 6,058,646 | A * | 5/2000 | Bishoff et al. | 43/131 |
| 6,088,950 | A * | 7/2000 | Jones | 43/124 |
| 6,109,297 | A * | 8/2000 | Shackelford | 137/527.6 |
| 6,244,006 | B1 * | 6/2001 | Shue et al. | 52/302.1 |
| 6,360,493 | B1 * | 3/2002 | Torres, III | 52/101 |
| 6,647,670 | B1 * | 11/2003 | Dran | 52/16 |
| 6,682,415 | B1 * | 1/2004 | Vagedes | 454/339 |
| D486,891 | S * | 2/2004 | Cronce, Jr. | D23/260 |
| 6,772,538 | B2 * | 8/2004 | Vagedes | 34/606 |
| 7,132,045 | B1 | 11/2006 | Trangsrud | |
| 2002/0153049 | A1 | 10/2002 | Brown et al. | |
| 2003/0014905 | A1 * | 1/2003 | Baker | 43/124 |
| 2004/0221891 | A1 | 11/2004 | Barratt | |
| 2005/0034376 | A1 | 2/2005 | Pourdeyhimi et al. | |
| 2005/0092372 | A1 * | 5/2005 | Wade | 137/527.6 |
| 2006/0049085 | A1 | 3/2006 | Parker | |
| 2006/0086672 | A1 | 4/2006 | Goliszewski | |
| 2006/0086674 | A1 | 4/2006 | Morgan | |
| 2006/0101723 | A1 * | 5/2006 | Baeta | 52/16 |
| 2007/0251093 | A1 * | 11/2007 | Kozik | 29/897 |

FOREIGN PATENT DOCUMENTS

| | | |
|---|---|---|
| JP | 11071790 | 3/1999 |
| WO | WO 2004065717 | 8/2004 |

* cited by examiner

RODENT GUARD

CROSS REFERENCE TO RELATED APPLICATION

This application claims the benefit of U.S. Provisional Patent Application Ser. No. 60/933,082, filed Jun. 4, 2007, the entirety of which is incorporated by reference herein.

FIELD OF THE INVENTION

This disclosure is directed generally to gutter systems for collecting rainwater, and more particularly, to rodent guards for preventing rodents from entering gutter downspouts.

BACKGROUND

Conventional gutter systems effectively catch rainwater from roofs and channel the rainwater to a desired location to eliminate washouts in undesired locations. Some of the downspouts terminate at the ground and provide unobstructed pathways for rodents to travel to the roof of a structure and ultimately into the structure. Rodents often carry diseases and create unhealthy conditions. In addition, rodents can be very destructive within structures, such as homes and other buildings. Thus, a need exists for preventing rodents from entering a gutter system.

SUMMARY OF THE INVENTION

A rodent guard configured to be attached to an end of a gutter for preventing rodents from entering the gutter, climbing the gutter to the roof and entering a house is disclosed. The rodent guard may be formed from a rodent guard body that is configured to fit closely with an end of a gutter, such as, but not limited to a downspout, to prevent rodents from entering the gutter. The rodent guard may also include a perforated cover that may removably attached to the rodent guard body. The removability of the perforated cover facilitates removal of debris, such as leaves, from the gutters by first removing the perforated cover. Because gutter downspouts are typically positioned at ground level, the gutter downspouts may be cleaned without a person having to climb a ladder to clean the gutters at the rooftop height, thereby reducing the injury risk inherent when working from a ladder.

The rodent guard includes a rodent guard body configured to be attached to an end of a gutter, having a gutter receiving opening at one end and a cover receiving opening at a second end generally opposite to the first end. The rodent guard may also include a perforated cover removably attached to the rodent guard body at the second end that enables the cover to be removed from the rodent guard body during use such that debris within the gutter can be easily removed from the gutter. The rodent guard body may fit around a gutter. In particular, the rodent guard body may include inside dimensions that are larger than outside dimensions of the gutter such that the rodent guard body can be installed at the end of the gutter by positioning the rodent guard body around the outside of the gutter, thereby preventing the rodent guard body from obstructing water flow through the gutter. The rodent guard body may also include a positioning ridge extending inwardly from an inner surface of the rodent guard body such that at least a portion of the positioning ridge contacts an end of the gutter when installed on a gutter to assist in proper positioning of the rodent guard body on the gutter.

The rodent guard may include a positioning system formed from plurality of tabs extending from the perforated cover for removably attaching the perforated cover to the rodent guard body. At least one of the plurality of tabs may include a protrusion extending inwardly from an inner surface of the tab, and the rodent guard body may include a recess configured to receive the protrusion extending from the tab such that the protrusion is positively seated within the recess. The rodent guard body may also include tab guide recesses for receiving each of the tabs.

The rodent guard may include at least one connector for attaching the rodent guard body to a gutter. The at least one connector may include at least one screw positioned in an orifice in the rodent guard body. The at least one screw may be offset from a centerline of the rodent guard body such that the screw is misaligned with a seam of the gutter to make installation easier.

The perforations of the perforated cover may have areas of between about 0.15 square inches and about 0.035 square inches. In particular, the perforations may be generally rectangular with dimensions no larger than about 0.375 inches. The perforated cover may also include indicia on the perforated cover with maintenance instructions, such as "Keep Clean." The perforated cover may have an outer surface that is substantially flush with an outer surface of the rodent guard body. The rodent guard body and the perforated cover may be formed from a material with a color that substantially matches a color of the gutter to which the gutter is attached. The perforated cover and the rodent guard body may be formed from a rigid material.

An advantage of this invention is that the rodent guard prevents rodents from getting into a house by climbing into the downspout of a gutter system and up the gutter.

Another advantage of this invention is that the rodent guard includes a removable face that facilitates easy access to debris within the gutter at the ground level and does not require one to remove debris from a gutter at the roof height, thereby eliminating the risks inherent with working from a ladder.

Still another advantage of this invention is that the rodent guard enables one to easily see the debris in the gutter and permits easy removal.

Another advantage of this invention is that the rodent guard slips over the end of a gutter downspout, thereby positioning the rodent guard body out of the flow of water, thereby lessening the degree of blockage by the guard.

Yet another advantage of this invention is that the rodent guard can be manufactured in different sizes to accommodate different sized gutters.

These and other components are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
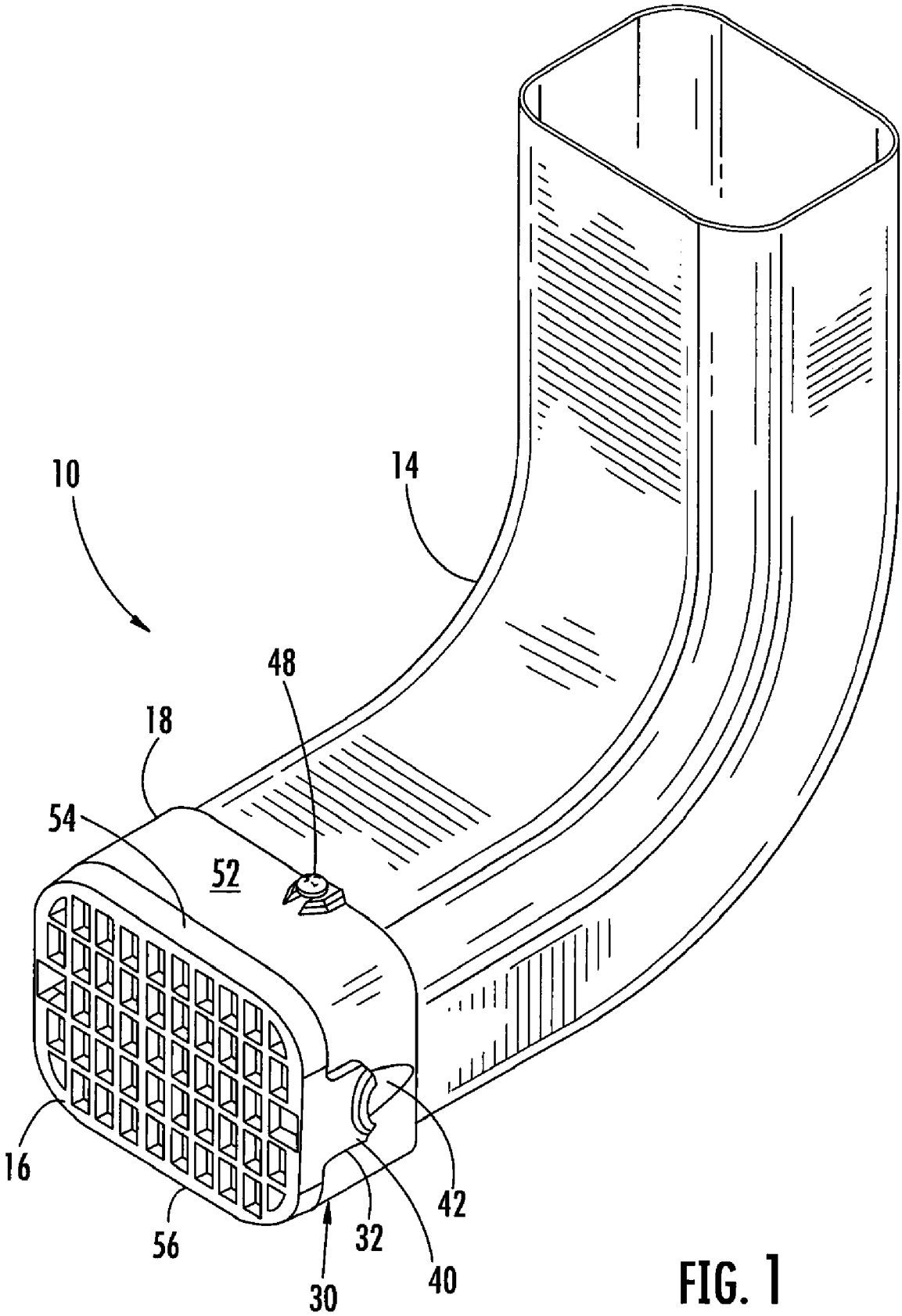
FIG. 1 is a perspective view of a rodent guard attached to a gutter downspout.
Figure 2:
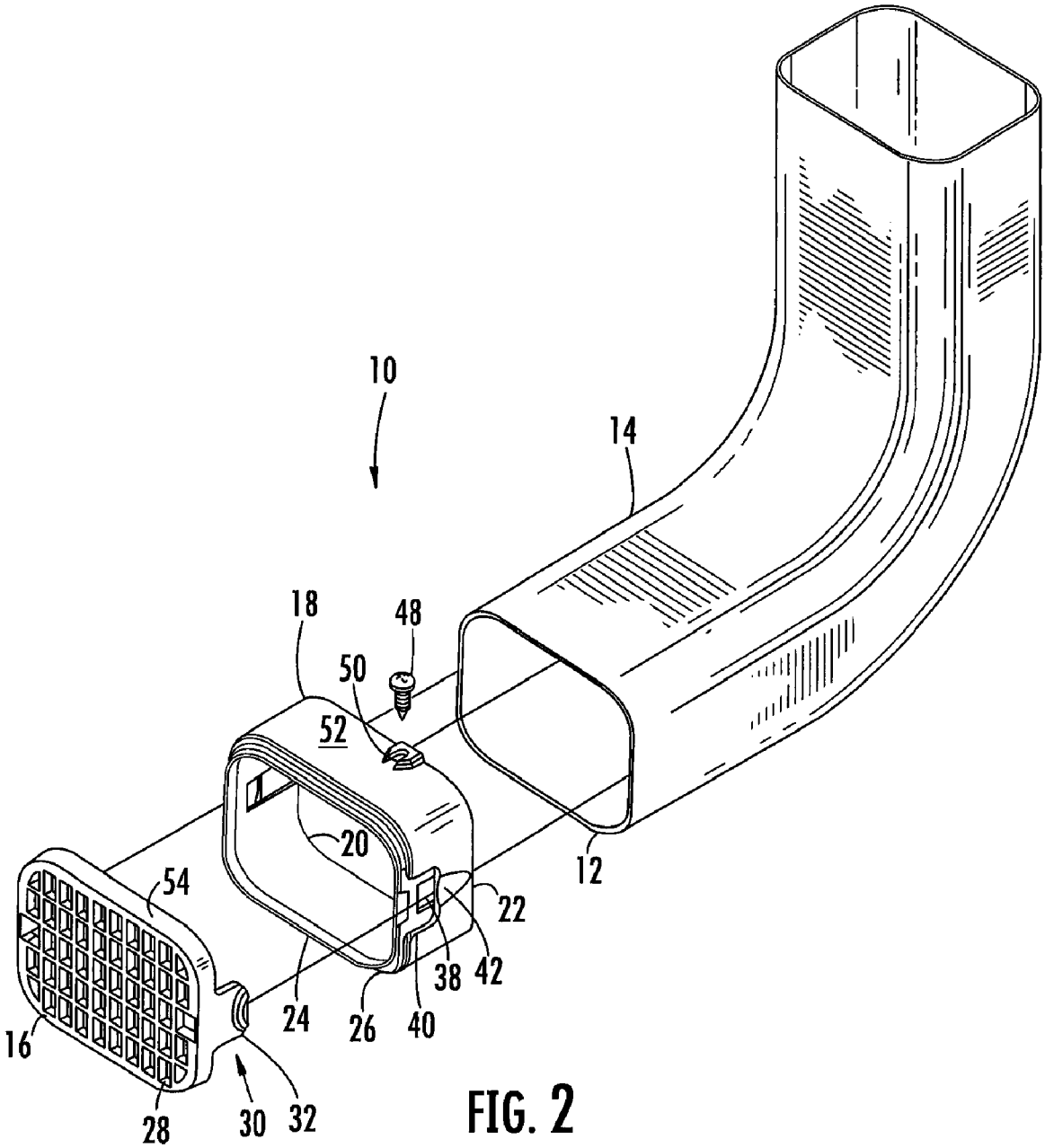
FIG. 2 is an exploded perspective view of the rodent guard shown in FIG. 1 and attached to a gutter downspout.
Figure 3:
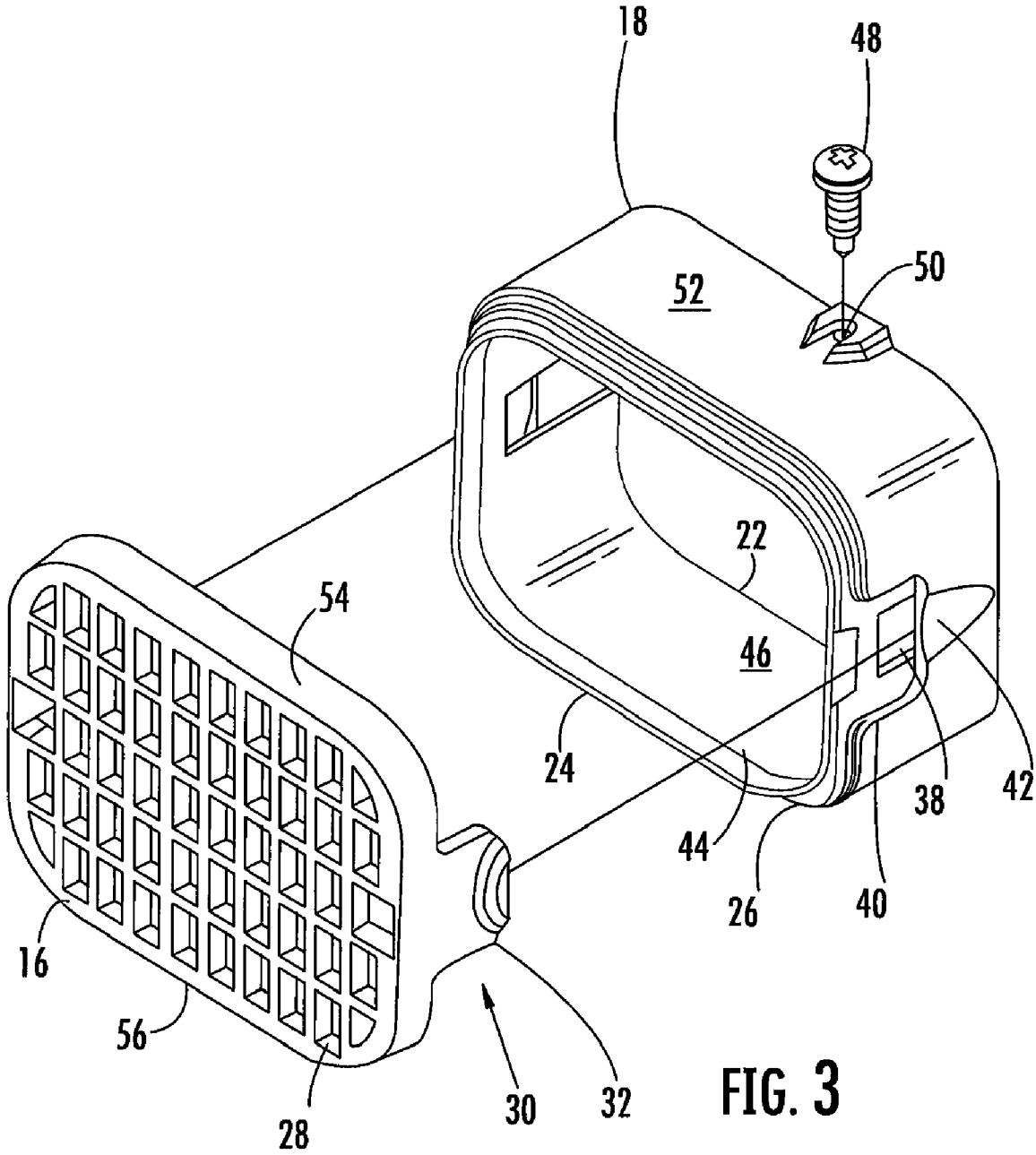
FIG. 3 is an exploded perspective view of the rodent guard shown in FIG. 1.
Figure 4:
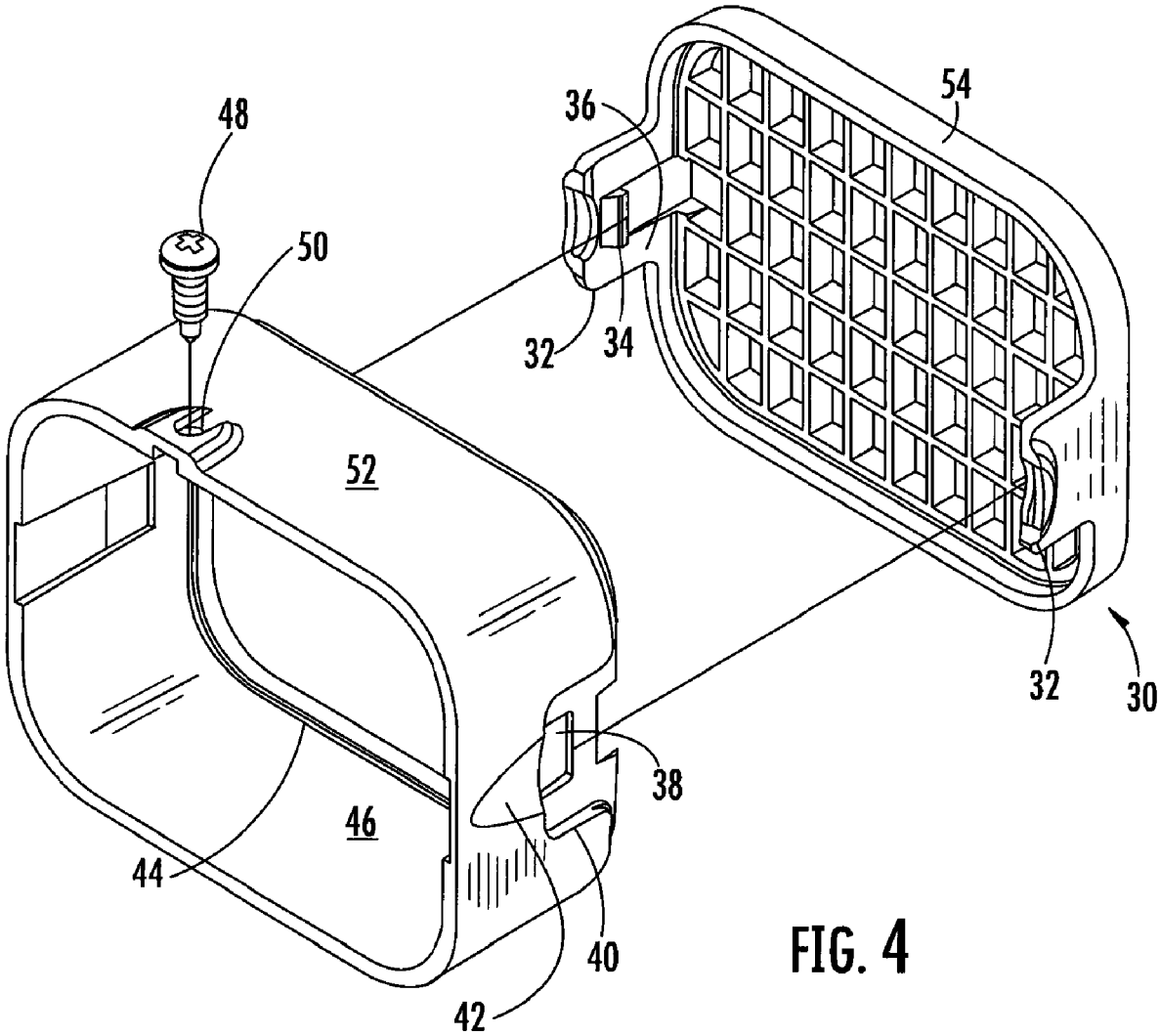
FIG. 4 is an exploded perspective view of the rodent guard shown in FIG. 1.

As shown in FIGS. 1-4, a rodent guard 10 configured to be attached to an end 12 of a gutter 14 for preventing rodents from entering the gutter 14, climbing the gutter 14 to the roof and entering a house is disclosed. The rodent guard 10 may be formed from a rodent guard body 18 that is configured to fit closely with an end 12 of a gutter 14, such as, but not limited to a downspout, to prevent rodents from entering the gutter 14. The rodent guard 10 may also include a perforated cover 16 that may removably attached to the rodent guard body 18. The perforated cover 16 may be removed and replaced easily without tools. The removability of the perforated cover 16 facilitates removal of debris, such as leaves, from the gutters 14 by removing the perforated cover 16 yet enables the rodent guard body 18 to remain attached to the gutter 14. Because gutter downspouts 14 are typically positioned at ground level, the gutter downspouts 14 may be cleaned without a person having to climb a ladder to clean the gutters at the rooftop height, thereby reducing the injury risk.

As shown in FIGS. 1-4, the rodent guard 10 may be formed from the rodent guard body 18. The rodent guard body 18 may configured to be attached to the end 12 of a gutter 14. The rodent guard body 18 may have a gutter receiving opening 20 at one end 22 and a cover receiving opening 24 at a second end 26 generally opposite to the first end 22. The second end 26 may have a beveled surface that facilitates a secure and smooth attachment of the perforated cover 16 to the rodent guard body 18. The rodent guard 10 may be formed from any appropriate rigid material, such as, but not limited to, plastics. In one embodiment, the rodent guard body 10 may be a unitary structure, and in other embodiments, may be formed from two or more pieces. The rodent guard body 18 may have inside dimensions that are larger than outside dimensions of the gutter 14 such that the rodent guard body 18 can be installed at the end of the gutter 14 by positioning the rodent guard body 18 around the outside of the gutter 14, thereby preventing the rodent guard body 18 from obstructing water flow through the gutter 14. In at least one embodiment, the inside dimensions of the rodent guard body 18 may be only slightly larger than the outside dimensions of the gutter 14 such that the rodent guard body 18 may be slid onto the gutter 14 without forming gaps between the rodent guard body 18 and the gutter 14 that would enable a rodent to enter the gutter 14. Thus, the rodent guard body 18 may be sized to be slightly larger than gutter 14 yet not too large that the purpose of the rodent guard 10 is defeated.

The rodent guard 10 may also include the perforated cover 16. The perforated cover 16 may be removably attached to the rodent guard body 18 at the second end 26 that enables the cover 16 to be removed from the rodent guard body 18 during use such that debris within the gutter 14 can be easily removed from the gutter 14. In this position, an outer surface 54 of the perforated cover 16 may be substantially flush with an outer surface 52 of the rodent guard body 18. In other embodiments, the perforated cover 16 may have other configurations in relation to the rodent guard body 18. In at least one embodiment, the perforated cover may be attached directly to the downspout of the gutter 14 such that the rodent guard body 18 is not needed. The perforated cover 16 may also include indicia 56 on the perforated cover 16 with maintenance instructions, such as "Keep Clean." Other instructions may be included on the cover 16 as needed.

The perforations 28 may be sized such that rodents may not chew on the cover 16 and obtain access to the gutter 14. For instance, the perforations 28 of the perforated cover 16 have areas of between about 0.15 square inches and about 0.035 square inches. In one embodiment, the perforations 28 may be generally rectangular with long dimensions between about ⅜ inch and about 3/16 inch. In another embodiment, the perforations 28 may be generally rectangular with dimensions no larger than about 0.375 inch (⅜ inch). The perforated cover 16 may be formed from appropriate rigid materials, such as, but not limited to, plastic. The perforated cover 16 and the rodent guard body 18 may be formed from the same materials and may be formed from the same color. The color of the rodent guard 10 may be matched with the color of the gutter 14.

The rodent guard 10 may include a positioning system 30 formed from plurality of tabs 32 extending from the perforated cover 16 for removably attaching the perforated cover 16 to the rodent guard body 18. The tabs 32 may extend from the perforated cover 16 or in an alternative embodiment, the tabs 32 may extend from the rodent guard body 18. The tabs 32 may extend from opposite sides of the rodent guard body 18 and be generally parallel to each other. One or more of the tabs 32 may include one or more protrusions 34 extending inwardly from an inner surface 36 of the tab 32. The rodent guard body 18 may include a recess 38 configured to receive the protrusion 34 extending from the tab 32 such that the protrusion 34 is positively seated within the recess 38. The positioning system 30 may be configured such that when the perforated cover 16 is slid onto the rodent guard body 18, the tabs 32 flex outwardly and the protrusions 34 are forced into the recesses 38. The tabs and protrusions 34 create an audible snap when the protrusions 34 are moved into the recesses 38. In this position, the tabs 32 may fit within tab guide recesses 40 in the outer surface of the rodent guard body 18 for receiving the tabs 32. The outer surface 54 of the rodent guard body 18 may include finger pull indentations 42 that facilitate removal of the perforated cover 16. The finger pull indentations 42 may be any appropriate shape and size.

The rodent guard body 18 may include a positioning ridge 44 extending inwardly from an inner surface 46 of the rodent guard body 18 such that at least a portion of the positioning ridge 44 contacts an end of the gutter 14 when installed on a gutter 14 to assist in proper positioning of the rodent guard body 18 on the gutter 14. In particular, the positioning ridge 44 prevents the rodent guard body 18 from being pushed too far onto a gutter 14 such that the gutter 14 extends out of the second end 26. The positioning ridge 44 may be any appropriate shape and size. The positioning ridge 44 may be continuous or discontinuous and may extend about a portion of the inner surface 46 of the rodent guard body 18 or extend continuously about the perimeter of the inner surface 46.

The rodent guard 10 may include one or more connectors 48 for attaching the rodent guard body 18 to a gutter 14. In one embodiment, the connector 48 may be one or more screws positioned in an orifice 50 in the rodent guard body 18. The orifice 50 may be positioned in a raised connector receiving area for obscuring the connector 48 from view. The orifice 50 may also include a beveled surface that facilitates attachment of the connector to the gutter 14. The screws may be formed from any appropriate materials, such as, but not limited to, metals including rust resistant galvanized steel and stainless steel. The connector 48 may also be a self-tapping screw. The connector 48 may be offset from a centerline of the rodent guard body 18 such that the screw is misaligned with a seam of the gutter 14, thereby facilitating easy assembly.

During use, the rodent guard 10 may be installed onto a gutter 14 by sliding the rodent guard body 18 onto the end 12 of the gutter 14 until the end 12 of the gutter 14 contacts the positioning ridge 44. The connector 48 may be attached to the gutter 14 to prevent the rodent guard 10 from being inadvertently removed from the gutter 14. During use, collected rainwater flows down through the gutter 14 and downspout and flows through the perforated cover 16. Debris may collect in the gutter 14 at the perforated cover 16. The debris may be visible without removing the perforated cover 16. Thus, the rodent guard 10 may be easily monitored by looking at the perforated cover 16 for debris collected there. If debris is present, the perforated cover 16 may be easily removed using the finger pull indentations 42 to facilitate grabbing the tabs 32 on the perforated cover 16 and sliding the perforated cover 16 off of the rodent guard body 18. The debris may be removed by grabbing the debris and removing it from the gutter 14. The perforated cover 16 may be replaced by pushing the perforated cover 16 onto the rodent guard body 18 such that the tabs 32 slide into the tab guide recess 40 so that the protrusions 34 reside within the recesses 38, thereby positively seating the protrusions 34 within the recesses 38. In this position, the protrusions 34 are locked into the recessed 38 thereby preventing inadvertent release of the perforated cover 16 from the rodent guard body 18.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A rodent guard, comprising:

a rodent guard body configured to be attached to an end of a gutter, having a gutter receiving opening at one end and a cover receiving opening at a second end generally opposite to the first end; and a perforated cover removably attached to the rodent guard body at the second end that enables the cover to be removed from the rodent guard body during use such that debris within the gutter can be easily removed from the gutter; and a positioning system formed from plurality of tabs extending from the perforated cover in a direction of flow of water through the rodent guard for removably attaching the perforated cover to an outer surface of the rodent guard body.

2. The rodent guard of claim 1, wherein the rodent guard body has inside dimensions that are larger than outside dimensions of the gutter such that the rodent guard body can be installed at the end of the gutter by positioning the rodent guard body around the outside of the gutter, thereby preventing the rodent guard body from obstructing fluid flow through the gutter.

3. The rodent guard of claim 2, further comprising a positioning ridge extending inwardly from an inner surface of the rodent guard body such that at least a portion of the positioning ridge contacts an end of the gutter when installed on a gutter to assist in proper positioning of the rodent guard body on the gutter.

4. The rodent guard of claim 1, wherein at least one of the plurality of tabs includes a protrusion extending inwardly from an inner surface of the tab and wherein the rodent guard body includes a recess configured to receive the protrusion extending from the tab such that the protrusion is positively seated within the recess.

5. The rodent guard of claim 1, wherein the rodent guard body includes tab guide recesses for receiving each of the tabs.

6. The rodent guard of claim 1, further comprising at least one connector for attaching the rodent guard body to the gutter.

7. The rodent guard of claim 6, wherein the at least one connector comprises at least one screw positioned in an orifice in the rodent guard body.

8. The rodent guard of claim 7, wherein the at least one screw is offset from a centerline of the rodent guard body such that the screw is misaligned with a seam of the gutter.

9. The rodent guard of claim 1, wherein the perforations of the perforated cover have areas of between about 0.15 square inches and about 0.035 square inches.

10. The rodent guard of claim 9, wherein the perforations are generally rectangular with dimensions no larger than about 0.375 inches.

11. The rodent guard of claim 1, further comprising indicia on the perforated cover with maintenance instructions.

12. The rodent guard of claim 1 wherein the perforated cover has an outer surface that is substantially flush with an outer surface of the rodent guard body.

13. The rodent guard of claim 1, wherein the rodent guard body and the perforated cover are formed from a material with a color that substantially matches a color of the gutter to which the gutter is attached.

14. The rodent guard of claim 1, wherein the perforated cover is formed from a rigid material.

15. A rodent guard, comprising:

a rodent guard body configured to be attached to an end of a gutter, having a gutter receiving opening at one end and a cover receiving opening at a second end generally opposite to the first end;

a perforated cover formed from a rigid material and removably attached to the rodent guard body at the second end that enables the cover to be removed from the rodent guard body during use such that debris within the gutter can be easily removed from the gutter;

wherein the rodent guard body has inside dimensions that are larger than outside dimensions of the gutter such that the rodent guard body can be installed at the end of the gutter by positioning the rodent guard body around the outside of the gutter, thereby preventing the rodent guard body from obstructing fluid flow through the gutter; and a positioning system formed from plurality of tabs extending from the perforated cover for removably attaching the perforated cover to the rodent guard body;

wherein at least one of the plurality of tabs includes a protrusion extending inwardly from an inner surface of the tab and wherein the rodent guard body includes a recess configured to receive the protrusion extending from the tab such that the protrusion is positively seated within the recess.

16. The rodent guard of claim 15, further comprising a positioning ridge extending inwardly from an inner surface of the rodent guard body such that at least a portion of the positioning ridge contacts an end of the gutter when installed on a gutter to assist in proper positioning of the rodent guard body on the gutter.

17. The rodent guard of claim 15, further comprising at least one connector for attaching the rodent guard body to the gutter that is offset from a centerline of the rodent guard body such that the screw is misaligned with a seam of the gutter.

18. The rodent guard of claim 15, wherein the perforations of the perforated cover have areas of between about 0.15 square inches and about 0.035 square inches.

* * * * *